US010712060B2

(12) United States Patent
Adachi et al.

(10) Patent No.: US 10,712,060 B2
(45) Date of Patent: Jul. 14, 2020

(54) POWER GENERATION METHOD

(71) Applicant: Kobe Steel, Ltd., Hyogo (JP)

(72) Inventors: Shigeto Adachi, Takasago (JP); Masayoshi Matsumura, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 16/415,871

(22) Filed: May 17, 2019

(65) Prior Publication Data

US 2019/0368787 A1 Dec. 5, 2019

(30) Foreign Application Priority Data

Jun. 5, 2018 (JP) ..... 2018-107550

(51) Int. Cl.

| | |
|---|---|
| ***F25B 41/00*** | (2006.01) |
| ***F01K 13/02*** | (2006.01) |
| ***F01K 23/06*** | (2006.01) |
| ***F01K 25/08*** | (2006.01) |
| *F25B 27/00* | (2006.01) |

(52) U.S. Cl.

CPC ..... *F25B 41/00* (2013.01); *F01K 13/02* (2013.01); *F01K 23/06* (2013.01); *F01K 25/08* (2013.01); *F25B 27/00* (2013.01)

(58) Field of Classification Search

CPC ..... F01K 13/00; F01K 13/02; F01K 25/06; F01K 25/08; F01K 25/10; F22G 5/00

USPC ..... 60/649, 651, 671

See application file for complete search history.

(56) References Cited

U.S. PATENT DOCUMENTS

| | | | | |
|---|---|---|---|---|
| 5,136,854 | A * | 8/1992 | Abdelmalek | B01D 53/002 60/651 |
| 5,214,932 | A * | 6/1993 | Abdelmalek | B01D 53/002 60/651 |
| 8,512,591 | B2 * | 8/2013 | Low | C08J 9/146 134/36 |
| 8,763,398 | B1 * | 7/2014 | Kalina | F01K 25/06 60/649 |
| 10,435,604 | B2 * | 10/2019 | Kontomaris | C09K 5/04 |
| 2006/0277911 | A1 * | 12/2006 | Rhodes | F01K 21/045 60/670 |

(Continued)

*Primary Examiner* — Mark A Laurenzi
*Assistant Examiner* — Mickey H France
(74) *Attorney, Agent, or Firm* — Studebaker & Brackett PC

(57) ABSTRACT

A power generation method capable of obtaining, even after switching a refrigerant, the equivalent power generation amount before the switching includes: a step of, during reference operation for circulating a reference refrigerant as a working medium within a circulation pathway and operating a binary generator, acquiring information of a control target of superheat of the reference refrigerant evaporated in an evaporator; a step of filling as the working medium, in the circulation pathway, mixed refrigerants by mixing a high-vapor pressure refrigerant and a low-vapor pressure refrigerant than the reference refrigerant in the ratio in which its vapor pressure equals the reference refrigerant; and a step of operating the binary generator while circulating the mixed refrigerants as the working medium within the circulation pathway and controlling superheat of the mixed refrigerants evaporated in the evaporator so as to equal the control target of the superheat of the reference refrigerant.

7 Claims, 4 Drawing Sheets

(56) References Cited

U.S. PATENT DOCUMENTS

| | | | | |
|---|---|---|---|---|
| 2011/0167818 | A1* | 7/2011 | Tsuchino | F02G 5/02 60/618 |
| 2013/0119299 | A1* | 5/2013 | Low | B01D 11/0288 252/68 |
| 2013/0325732 | A1* | 12/2013 | Low | F25B 45/00 705/317 |
| 2014/0174084 | A1* | 6/2014 | Kontomaris | C09K 5/045 60/651 |
| 2015/0075165 | A1* | 3/2015 | Low | G06Q 30/018 60/671 |
| 2015/0152749 | A1* | 6/2015 | Nishiguchi | C09K 5/045 60/651 |
| 2015/0247427 | A1* | 9/2015 | Takahashi | F01K 25/08 60/663 |
| 2016/0032786 | A1* | 2/2016 | Zampieri | F01K 25/08 60/670 |
| 2016/0290175 | A1* | 10/2016 | Kontomaris | C09K 5/045 |
| 2017/0191704 | A1* | 7/2017 | Kim | F01K 13/02 |
| 2017/0298781 | A1* | 10/2017 | Martineau | F01K 25/08 |
| 2018/0066871 | A1 | 3/2018 | Matsukura et al. | |
| 2018/0215979 | A1* | 8/2018 | Kontomaris | F01K 25/08 |
| 2018/0274392 | A1* | 9/2018 | Tsuboi | F01D 17/02 |
| 2020/0131943 | A1* | 4/2020 | Kontomaris | F01K 25/08 |

* cited by examiner

POWER GENERATION METHOD

BACKGROUND OF THE INVENTION

Field of the Invention

The present invention relates to a power generation method.

Description of the Related Art

Conventionally, a binary power generation method for recovering heat energy of a heat source such as warm water or steam as electric energy via a working medium is known. A binary power generation device used in the method has a configuration in which respective apparatuses such as an evaporator, an expander, a condenser and a working medium pump are arranged in a circulation pathway filled with a working medium which is a low-boiling refrigerant. According to the power generation method, the low-boiling refrigerant is evaporated via heat exchange with a heat source in the evaporator, and a rotor of a power generator is rotated by the rotational driving force obtained by expanding the refrigerant vapor by the expander, thereby energy conversion from heat of the heat source to electric power is possible.

In a conventional power generation method, a refrigerant such as hydrofluorocarbon (HFC) is circulated within the circulation pathway as a working medium. Moreover, J P 2016-194377 A discloses a refrigerant circulation method in which a refrigerant including hydrofluoroolefin (HFO) is circulated within a circulation pathway.

In the meantime, in recent years, in order to reduce environmental load, strict regulations are being imposed on refrigerants. Here, HFO is a refrigerant having a small environmental load, but the vapor pressure thereof is different from that of HFC which is an existing refrigerant. Therefore, in a case where HFO is used instead of HFC as a working medium, the pressure on a suction side of the expander is changed, thereby the power generation amount is changed. Thus, conventionally, there is a problem that, after switching of the refrigerant, the power generation amount equivalent to that before the switching cannot be obtained.

The present invention has been made in view of the above-described problem, and an object thereof is to provide a power generation method capable of obtaining, even after switching of a refrigerant, the power generation amount equivalent to that before the switching.

A power generation method according to one aspect of the present invention is a method for generating power using a power generation device including a circulation pathway through which a working medium circulates, an evaporator which evaporates the working medium via heat exchange with a heat source, an expander which expands the evaporated working medium, and a power generator which generates power by a rotational driving force due to expansion of the working medium. The power generation method includes: a step of, during reference operation for circulating a predetermined reference refrigerant as the working medium within the circulation pathway and operating the power generation device, acquiring information of a control target value of degree of superheat of the reference refrigerant evaporated in the evaporator; a step of filling as the working medium, in the circulation pathway, mixed refrigerants formed by mixing at least one kind of high vapor pressure refrigerant having a vapor pressure higher than that of the reference refrigerant and at least one kind of low vapor pressure refrigerant having a vapor pressure lower than that of the reference refrigerant in the ratio in which the vapor pressure thereof is equalized to that of the reference refrigerant; and a step of operating the power generation device while circulating the mixed refrigerants as the working medium within the circulation pathway and controlling degree of superheat of the mixed refrigerants evaporated in the evaporator so as to be equalized to the control target value of the degree of superheat of the reference refrigerant.

In the power generation method, the mixed refrigerants formed by mixing the high vapor pressure refrigerant and the low vapor pressure refrigerant in the ratio in which the vapor pressure thereof is equalized to that of the reference refrigerant is circulated within the circulation pathway, and the degree of superheat of the mixed refrigerants is controlled so as to be equalized to the control target value of the degree of superheat of the reference refrigerant. Therefore, even in power generation using the mixed refrigerants, the factors (pressure and degree of superheat of a refrigerant vapor on a suction side of the expander) affecting the power generation amount can be equalized to those in the reference operation using the reference refrigerant. In the power generation method of the present invention, the vapor pressure of the mixed refrigerants is same as the vapor pressure of the reference refrigerant, and therefore the degree of superheat of the mixed refrigerants can be adjusted to the control target value in the reference operation without changing the rotation number of a pump for circulating the refrigerant from that in the reference operation. Thus, according to the power generation method of the present invention, even after switching the refrigerant from the reference refrigerant to the mixed refrigerants, the power generation amount equivalent to that before the switching can be obtained.

In addition, the term "the vapor pressure of the mixed refrigerants is same as the vapor pressure of the reference refrigerant" herein is not intended to be limited to the case where the both vapor pressures are exactly the same, and the difference of the both vapor pressures within the scope of the purpose of obtaining the power generation amount equivalent to that before the switching of the refrigerant is permitted. Moreover, also as to the term "the degree of superheat of the mixed refrigerants is equalized to the control target value of the degree of superheat of the reference refrigerant", as with the above, it is not limited to the case where the both are exactly the same, and the difference within the scope of the above purpose is permitted.

In the above power generation method, the power generation device may further include a working medium pump for circulating the working medium in the circulation pathway. In the above power generation method, operation of the power generation device using the mixed refrigerants may be performed at the same rotation number as that of the working medium pump during the reference operation.

As described above, in the power generation method of the present invention, the vapor pressure of the mixed refrigerants is same as the vapor pressure of the reference refrigerant, and therefore, even if power generation is performed by circulating the mixed refrigerants at the same pump rotation number as that in the reference operation, the degree of superheat of the mixed refrigerants can be adjusted to the control target value in the reference operation.

In the above power generation method, the high vapor pressure refrigerant and the low vapor pressure refrigerant may be isomers to each other.

According to the method, by using the isomers, whose physical properties resemble each other except for the vapor pressure, as the high vapor pressure refrigerant and the low vapor pressure refrigerant respectively, design of an apparatus for giving resistance to the both refrigerants is facilitated.

In the above power generation method, the reference refrigerant may be R245fa. The high vapor pressure refrigerant may be a trans isomer of hydrofluoroolefin. The low vapor pressure refrigerant may be a cis isomer of hydrofluoroolefin having the same molecular formula as the high vapor pressure refrigerant.

According to the method, the power generation amount equivalent to the power generation using R245fa as the working medium can be obtained, and by using hydrofluoloolefin as the working medium, environmental load can be further reduced.

In the above power generation method, operation of the power generation device using the mixed refrigerants may be performed by using the expander of positive displacement type used in the reference operation.

In the power generation using the positive displacement expander, if the vapor pressure of the mixed refrigerants is different from the vapor pressure of the reference refrigerant, in order to obtain the power generation amount equivalent to that in the reference operation, the need to change a capacity ratio of the expander arises. In contrast, as described above, by using the mixed refrigerants formed by mixing the high vapor pressure refrigerant and the low vapor pressure refrigerant in the ratio in which the vapor pressure thereof is equalized to that of the reference refrigerant, even if the expander at the same capacity ratio as that in the reference operation is used, it is possible to secure the equivalent power generation amount.

In the above power generation method, the expander may be a screw expander.

In the above power generation method, the screw expander can be preferably used as an example of the positive displacement expander.

As is apparent from the above description, according to the present invention, it is possible to provide a power generation method capable of obtaining, even after switching of a refrigerant, the power generation amount equivalent to that before the switching.

DESCRIPTION OF THE PREFERRED EMBODIMENTS

Hereinafter, a power generation method according to an embodiment of the present invention will be described in detail based on the drawings.

(Binary Power Generation Device)

Figure 1:
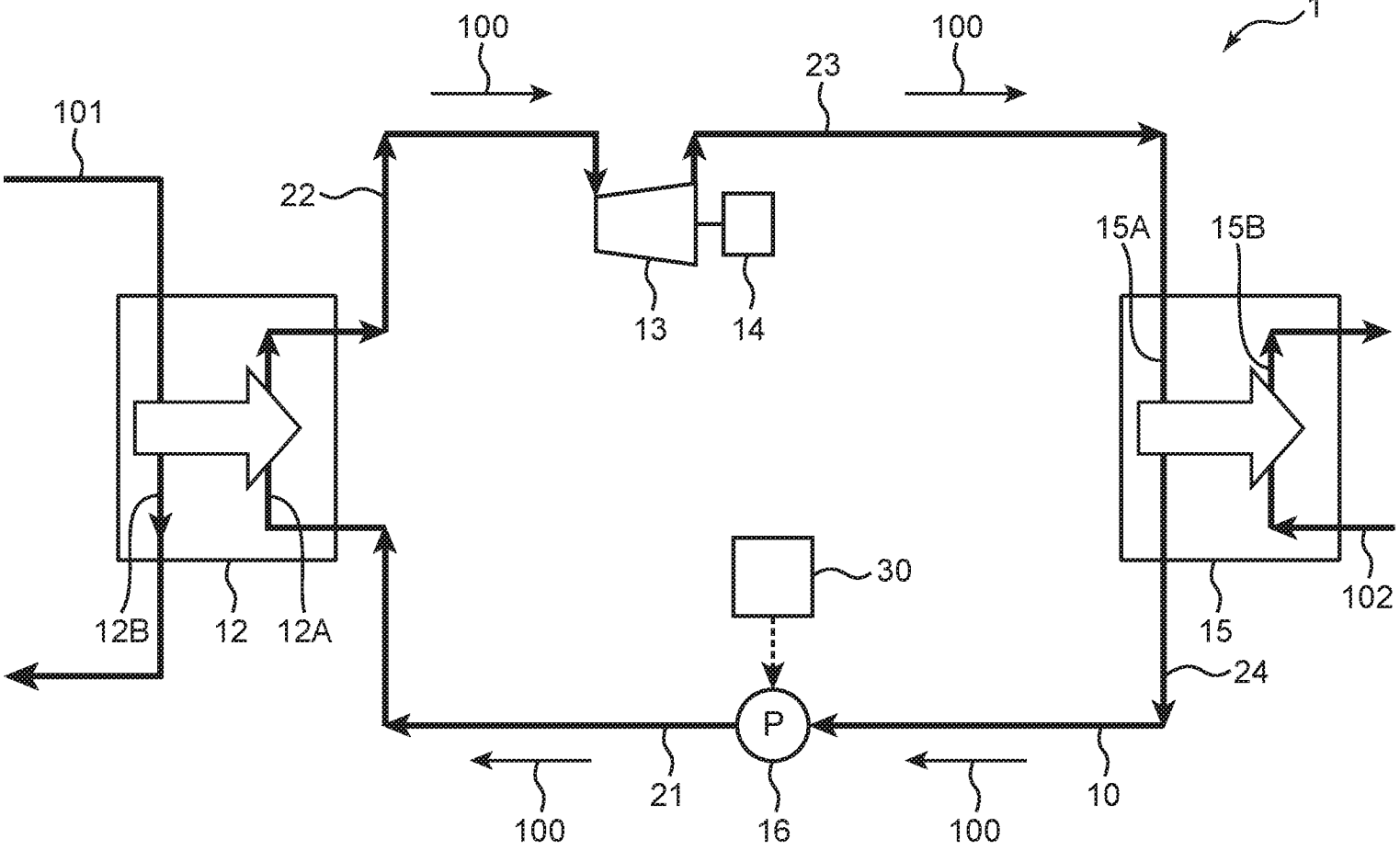
FIG. 1 is a diagram schematically showing a configuration of a binary power generation device used in a power generation method according to an embodiment of the present invention.

First, a configuration of a binary power generation device 1 used in the power generation method according to the present embodiment will be described with reference to FIG. 1. The binary power generation device 1 is a device for generating electric energy by heat recovered from a heat source 101, and as shown in FIG. 1, mainly includes a circulation pathway 10, a working medium pump 16, an evaporator 12, an expander 13, a power generator 14, and a condenser 15. In addition, FIG. 1 schematically shows only main components in the binary power generation device 1, and the binary power generation device 1 may further include any other components not shown in FIG. 1. Hereinafter, the components in the binary power generation device 1 will be described respectively.

The circulation pathway 10 is made up of a pipe through which a working medium 100 that is a low-boiling refrigerant circulates, and connects the respective apparatuses of the working medium pump 16, the evaporator 12, the expander 13, and the condenser 15 to each other. As shown in FIG. 1, the circulation pathway 10 includes a first pathway 21 for connecting a discharge port of the working medium pump 16 and an inlet of the evaporator 12, a second pathway 22 for connecting an outlet of the evaporator 12 and an inlet of the expander 13, a third pathway 23 for connecting an outlet of the expander 13 and an inlet of the condenser 15, and a fourth pathway 24 for connecting an outlet of the condenser 15 and a suction port of the working medium pump 16. By this configuration, the working medium 100 can be circulated through the working medium pump 16, the evaporator 12, the expander 13, and the condenser 15 in this order.

The working medium pump 16 is for circulating the working medium 100 in the circulation pathway 10. As shown in FIG. 1, the working medium pump 16 is, in a circulation direction of the working medium 100, arranged on a downstream side of the condenser 15 and on an upstream side of the evaporator 12. The working medium pump 16 pressurizes the liquid working medium 100 flowed out of the condenser 15 and sends it out toward the evaporator 12.

A rotation number (that is, a frequency) of the working medium pump 16 is automatically controlled, for example, by a control part 30, and it is possible to adjust a circulation volume of the working medium 100 within the circulation pathway 10 by the rotation number. In addition, the working medium pump 16 is not limited to a pump whose rotation number is variable, and may be a pump whose rotation number is fixed.

The evaporator 12 is a heat exchanger which evaporates the working medium 100 via heat exchange with the heat source 101. As shown in FIG. 1, the evaporator 12 is, in the circulation direction of the working medium 100, arranged on the downstream side of the working medium pump 16 and on the upstream side of the expander 13. The evaporator 12 includes a first heat exchange flow path 12A into which the liquid working medium 100 sent out from the working medium pump 16 flows, and a second heat exchange flow path 12B into which the heat source 101 flows. To an inlet of the first heat exchange flow path 12A, a downstream end of the first pathway 21 is connected, and to an outlet of the first heat exchange flow path 12A, an upstream end of the second pathway 22 is connected.

The heat source 101 is a heat medium having higher temperature than a boiling point of the working medium 100, and, for example, is a gaseous medium such as steam or high-temperature air, or a liquid medium such as warm water. However, the type of the heat source 101 is not limited to those, and various things can be used. Moreover, in a case where high-temperature air is used as the heat source 101, a cooler for cooling the high-temperature air after heat exchange flowed out of the second heat exchange flow path 12B may be provided.

In the evaporator 12, heat exchange is performed indirectly between the working medium 100 flowing through the first heat exchange flow path 12A and the heat source 101 flowing through the second heat exchange flow path 12B. Thereby, the liquid working medium 100 is heated by the heat source 101 and evaporated. The evaporated working medium 100 flows into the expander 13 through the second pathway 22. In addition, the evaporator 12 in the present embodiment is, for example, a plate heat exchanger, but the type of the heat exchanger is not particularly limited.

The expander 13 expands the gaseous working medium 100 evaporated in the evaporator 12. As shown in FIG. 1, the expander 13 is, in the circulation direction of the working medium 100, arranged on the downstream side of the evaporator 12 and on the upstream side of the condenser 15.

The expander 13 in the present embodiment is a positive displacement expander, and specifically is a screw expander. That is, the expander 13 has a pair of screw rotors (a male rotor and a female rotor) and a casing for accommodating the pair of screw rotors, and is configured such that a capacity (volume) of an enclosed space (a working chamber) constituted by the screw rotors and the casing is increased from a suction port of gas toward a discharge port. Thereby, the suctioned gaseous working medium 100 is expanded with the flowing toward the discharge port. Then, by a differential pressure of the working medium 100 before and after expansion, the screw rotors (a screw turbine) of the expander 13 rotate. The differential pressure is determined by a capacity ratio of the expander 13. In addition, the expander is not limited to the screw expander, and for example, a turbo or scroll expander may be used.

The power generator 14 generates power by a rotational driving force due to expansion of the working medium 100. Specifically, a rotor of the power generator 14 is connected to the expander 13 and is capable of rotating with the expander 13. Thus, the expander 13 is rotated by the evaporated working medium 100, and by its rotational driving force, power can be generated.

The condenser 15 is a heat exchanger which condenses the working medium 100 via heat exchange with a cooling source 102. As shown in FIG. 1, the condenser 15 is, in the circulation direction of the working medium 100, arranged on the downstream side of the expander 13 and on the upstream side of the working medium pump 16. The condenser 15 includes a first heat exchange flow path 15A into which the working medium 100 at low pressure flowed out of the expander 13 flows, and a second heat exchange flow path 15B into which the cooling source 102 flows. To an inlet of the first heat exchange flow path 15A, a downstream end of the third pathway 23 is connected, and to an outlet of the first heat exchange flow path 15A, an upstream end of the fourth pathway 24 is connected. The cooling source 102 is, for example, cooling water or the like, and is sent out toward the condenser 15 (the second heat exchange flow path 15B) by a cooling water circulation pump (not shown).

In the condenser 15, heat exchange is performed indirectly between the working medium 100 flowing through the first heat exchange flow path 15A and the cooling source 102 flowing through the second heat exchange flow path 15B, thereby the working medium 100 is cooled by the cooling source 102 and condensed. Then, the liquid working medium 100 flowed out of the condenser 15 is sucked in the working medium pump 16 through the fourth pathway 24. The condenser 15 in the present embodiment is, for example, a plate heat exchanger, but the type of the heat exchanger is not particularly limited.

Although the binary power generation device 1 according to the present embodiment has the above described configuration, in the binary power generation device 1, in order to obtain a desired power generation amount if HFC-R245fa (a reference refrigerant described later) is circulated as the working medium 100, the capacity ratio of the expander 13 is designed and the degree of superheat of the working medium 100 (the gaseous working medium 100 before being sucked in the expander 13 after being flowed out of the evaporator 12) evaporated in the evaporator 12 is controlled. That is to say, the binary power generation device 1 according to the present embodiment has a configuration (design) by which the desired power generation amount is obtained if HFC-R245fa is used as the working medium 100.

(Power Generation Method)

Next, the power generation method according to the present embodiment of generating power by using the above binary power generation device 1 will be described. First, a reference operation of the binary power generation device 1 performed before the power generation method according to the present embodiment will be described.

In the reference operation, a predetermined reference refrigerant is circulated as the working medium 100 within the circulation pathway 10 and the binary power generation device 1 is operated. In the present embodiment, the reference refrigerant is HFC-R245fa.

In the reference operation, in order to obtain the desired power generation amount, the degree of superheat of the evaporated working medium 100 (the working medium 100 flowing through the second pathway 22) is controlled. Specifically, temperature and pressure of the working medium 100 are detected respectively by a temperature sensor and a pressure sensor provided in the second pathway 22, the degree of superheat of the working medium 100 is calculated based on the detection results, and the rotation number of the working medium pump 16 is controlled by the control part 30 such that the calculated degree of superheat becomes a predetermined control target value. Alternatively, the working medium pump 16 (its rotation number is fixed) designed at the rotation number by which the degree of superheat can be adjusted to the predetermined control target value is used. In addition, the degree of superheat (an actual measured value) of the reference refrigerant during the reference operation may be constant or variable.

Figure 2:
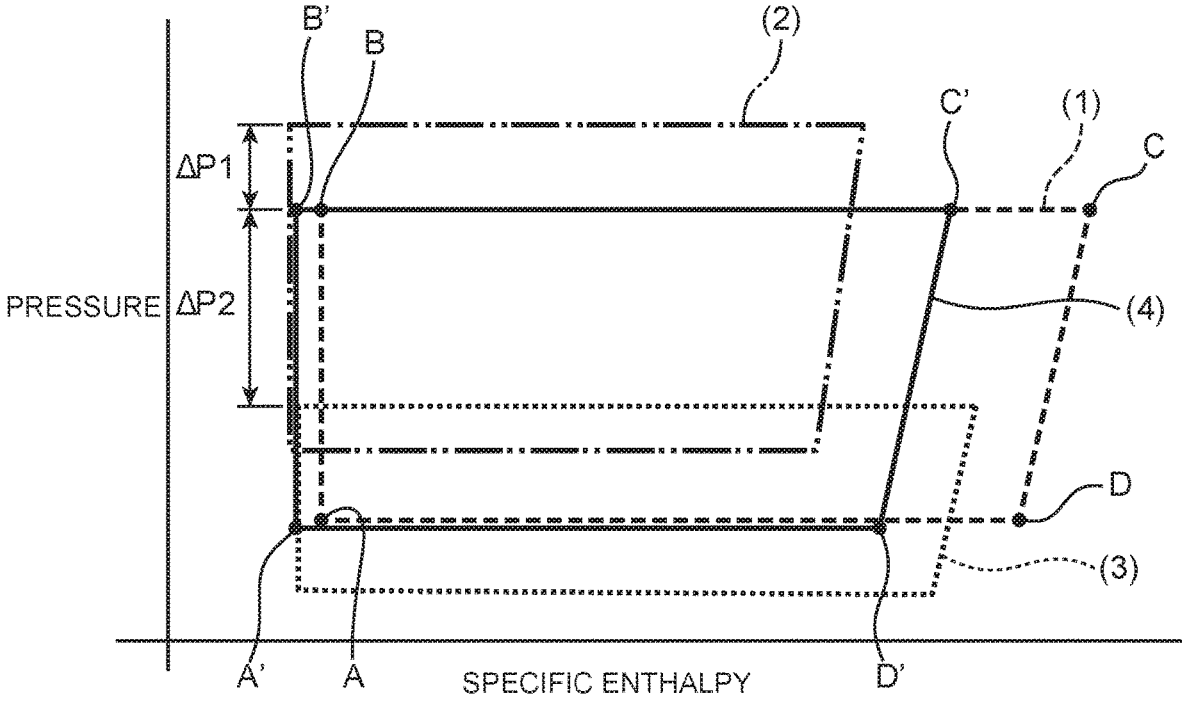
FIG. 2 is a p-h diagram schematically showing a state change of a working medium in binary power generation using hydrofluorocarbon and hydrofluoroolefin.

FIG. 2 is a p-h diagram showing a state change of the working medium 100 in a power generation process using the binary power generation device 1. In FIG. 2, a horizontal axis shows specific enthalpy, and a vertical axis shows pressure. Moreover, a broken line (1) in FIG. 2 shows a state change of the working medium 100 in the case where HFC-R245fa is used (in the reference operation).

As shown by the broken line (1) in FIG. 2, in the reference operation, the working medium 100 becomes a high-pressure liquid by being pressurized by the working medium pump 16 (from a point A to a point B), it becomes a high-pressure steam by being heated by the heat source 101 in the evaporator 12 (from the point B to a point C), it subsequently becomes a low-pressure steam by being expanded in the expander 13 (from the point C to a point D), and thereafter it becomes a low-pressure liquid by being cooled by the cooling source 102 in the condenser 15 (from the point D to the point A).

Next, the power generation method according to the present embodiment will be described according to a flow chart of FIG. 3. In the power generation method, the same device as the binary power generation device 1 used in the above reference operation is used as it is. That is, the apparatuses (the working medium pump 16, the expander 13, the evaporator 12, and the condenser 15) used in the present method are same as those used in the reference operation. In the power generation method, first, during the reference operation, a step of acquiring information of the control target value of the degree of superheat of the reference refrigerant evaporated in the evaporator 12 is performed (a step S1 in FIG. 3). The control target value may be set to any single value, or may be set within any range. In addition, the above-mentioned reference operation is for the purpose of acquiring the information of the control target value of the degree of superheat in the present step. Thus, if execution of the reference operation is unnecessary for acquiring the information, the reference operation does not need to be executed each time before the present power generation method, and the reference operation may be omitted.

Figure 3:
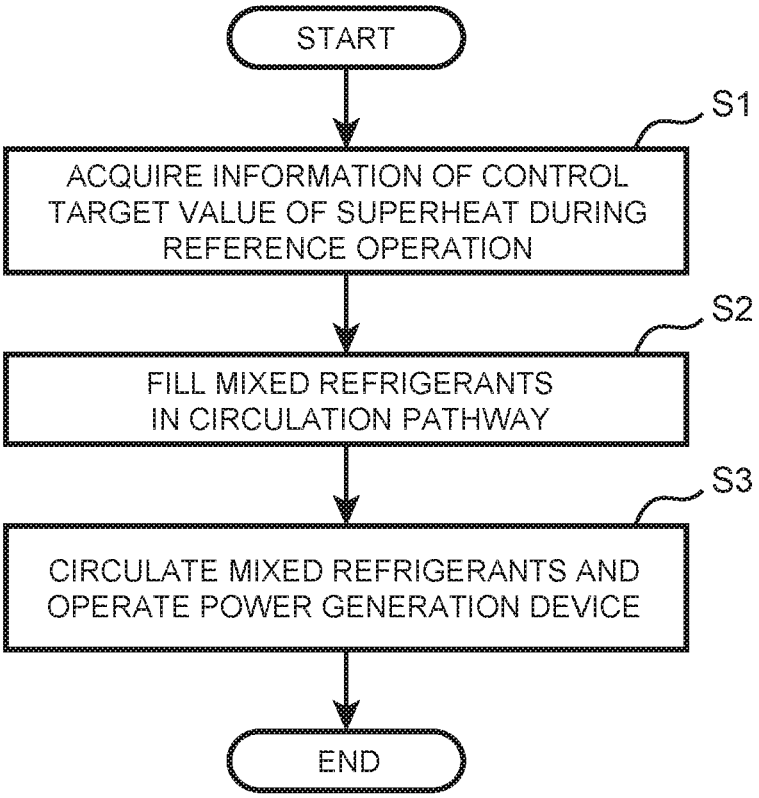
FIG. 3 is a flow chart showing procedures of the power generation method according to the embodiment of the present invention.

Next, a step of filling mixed refrigerants as the working medium 100 in the circulation pathway 10 is performed (a step S2 in FIG. 3). The mixed refrigerants are formed by mixing at least one kind of high vapor pressure refrigerant having a vapor pressure higher than that of the reference refrigerant (HFC-R245fa) and at least one kind of low vapor pressure refrigerant having a vapor pressure lower than that of the reference refrigerant.

In the present step, the high vapor pressure refrigerant and the low vapor pressure refrigerant may be previously mixed and then filled in the pipe of the circulation pathway 10, or the high vapor pressure refrigerant and the low vapor pressure refrigerant may be respectively filled in the pipe of the circulation pathway 10 and then mixed in the pipe. In addition, at the time of filling of the mixed refrigerants, the working medium pump 16 is stopped.

In the present embodiment, the high vapor pressure refrigerant and the low vapor pressure refrigerant are geometric isomers to each other. Specifically, the high vapor pressure refrigerant is a trans isomer of hydrofluoroolefin, and the low vapor pressure refrigerant is a cis isomer of hydrofluoroolefin having the same molecular formula as the high vapor pressure refrigerant. For example, trans-1,3,3,3-tetrafluoroprop-1-ene can be used as the high vapor pressure refrigerant. Moreover, cis-1,3,3,3-tetrafluoroprop-1-ene can be used as the low vapor pressure refrigerant.

Here, a two-dot chain line (2) in FIG. 2 shows a state change of the working medium 100 in the case where the high vapor pressure refrigerant (the trans isomer of HFO) is used alone. Moreover, a dotted line (3) in the same figure shows a state change of the working medium 100 in the case where the low vapor pressure refrigerant (the cis isomer of HFO) is used alone.

As shown in FIG. 2, the high vapor pressure refrigerant and the low vapor pressure refrigerant are respectively different from the reference refrigerant (HFC-R245fa) in pressure at the time of vaporization. Specifically, the high vapor pressure refrigerant has the pressure at the time of vaporization higher than that of the reference refrigerant ($\Delta P1$ in FIG. 2), and on the other hand, the low vapor pressure refrigerant has the pressure at the time of vaporization lower than that of the reference refrigerant ($\Delta P2$ in FIG. 2). Thus, in a case where the high vapor pressure refrigerant and the low vapor pressure refrigerant are respectively filled in the circulation pathway 10 alone and the binary power generation device 1 is operated, the pressure of the working medium 100 flowing through the second pathway 22 is changed compared to that in the reference operation. As a result, the pressure of the working medium 100 on a suction side of the expander 13 is changed.

Here, the power generation amount by the binary power generation device 1 is affected by the pressure of the working medium 100 on the suction side of the expander 13. Therefore, when the pressure on the suction side of the expander 13 is changed as described above, the power generation amount to be obtained is changed compared to that in the reference operation. Against this, it is conceivable that the design (capacity ratio) of the expander 13 is changed according to the refrigerant to be used, but in that case, cost increase of the device is caused.

Then, in the power generation method according to the present embodiment, the binary power generation device 1 having the same device configuration as that in the reference operation is used, and the mixed refrigerants formed by mixing the high vapor pressure refrigerant (the trans isomer of HFO) and the low vapor pressure refrigerant (the cis isomer of HFO) in the ratio in which the vapor pressure thereof is equalized to that of the reference refrigerant (HFC-R245fa) are used. In the present embodiment, as an example, mixed refrigerants are prepared by mixing the high vapor pressure refrigerant and the low vapor pressure refrigerant in the ratio of 8:2, and the mixed refrigerants are filled in the pipe of the circulation pathway 10. The boiling point of the mixed refrigerants is the same or substantially the same as that of the reference refrigerant.

The state change of the working medium 100 in the binary power generation using the mixed refrigerants is as shown by a solid line (4) in FIG. 2. As shown by a cycle of the solid line (4), the pressure at the time of vaporization of the mixed refrigerants is same as the pressure at the time of vaporization of the reference refrigerant. Thus, even if the mixed refrigerants are used as the working medium 100 of the binary power generation device 1, the pressure of the working medium 100 flowing through the second pathway 22 is same as that in the reference operation. Thereby, the pressure on the suction side of the expander 13 can be equalized to that in the reference operation.

In the power generation method according to the present embodiment, by using HFO as the working medium 100, environmental load can be further reduced compared to the case where HFC is used as the working medium 100. Besides, by using the geometric isomers (the trans isomer and the cis isomer) of HFO as the high vapor pressure refrigerant and the low vapor pressure refrigerant, it is also advantageous in that selection of materials to be used for the apparatuses of the binary power generation device 1 is facilitated. That is, in a case where the refrigerants that are different substances are used respectively as the high vapor pressure refrigerant and the low vapor pressure refrigerant, it is necessary to select materials of the apparatuses in consideration of resistance (for example, corrosion resistance) to each refrigerant. In contrast, in the present embodiment, only resistance to HFO has to be considered, and therefore selection of materials of the apparatuses is easy.

In addition, in the present embodiment, the mixed refrigerants are prepared by using each one kind of the high vapor pressure refrigerant and the low vapor pressure refrigerant, but the present invention is not limited thereto. That is to say, the mixed refrigerants may be prepared by using multiple kinds of one or both of the high vapor pressure refrigerant and the low vapor pressure refrigerant.

Next, a step of operating the binary power generation device 1 by using the mixed refrigerants as the working medium 100 is performed (a step S3 in FIG. 3). In this step, by operating the working medium pump 16 at the same rotation number as that of the working medium pump 16 during the reference operation, the mixed refrigerants are circulated as the working medium 100 within the circulation pathway 10. Then, by rotating the expander 13 by the mixed refrigerants evaporated in the evaporator 12, a predetermined power generation amount is obtained.

Specifically, the state of the mixed refrigerants (the working medium 100) is changed according to the cycle of the solid line (4) in FIG. 2. That is, the mixed refrigerants become a high-pressure liquid by being pressurized by the working medium pump 16 (from a point A' to a point B'), become a high-pressure steam by being heated by the heat source 101 in the evaporator 12 (from the point B' to a point C'), become a low-pressure steam by being expanded in the expander 13 (from the point C' to a point D'), and thereafter become a low-pressure liquid by being cooled by the cooling source 102 in the condenser 15 (from the point D' to the point A).

In this step, the binary power generation device 1 is operated while controlling the degree of superheat of the mixed refrigerants (the mixed refrigerants flowing through the second pathway 22) evaporated in the evaporator 12 so as to be equalized to the control target value, which is previously acquired in the above step, of the degree of superheat of the reference refrigerant. Thereby, the degree of superheat (the actual measured value) of the mixed refrigerants is controlled so as to be substantially the same as the degree of superheat (the actual measured value) of the reference refrigerant during the reference operation.

Figure 4:
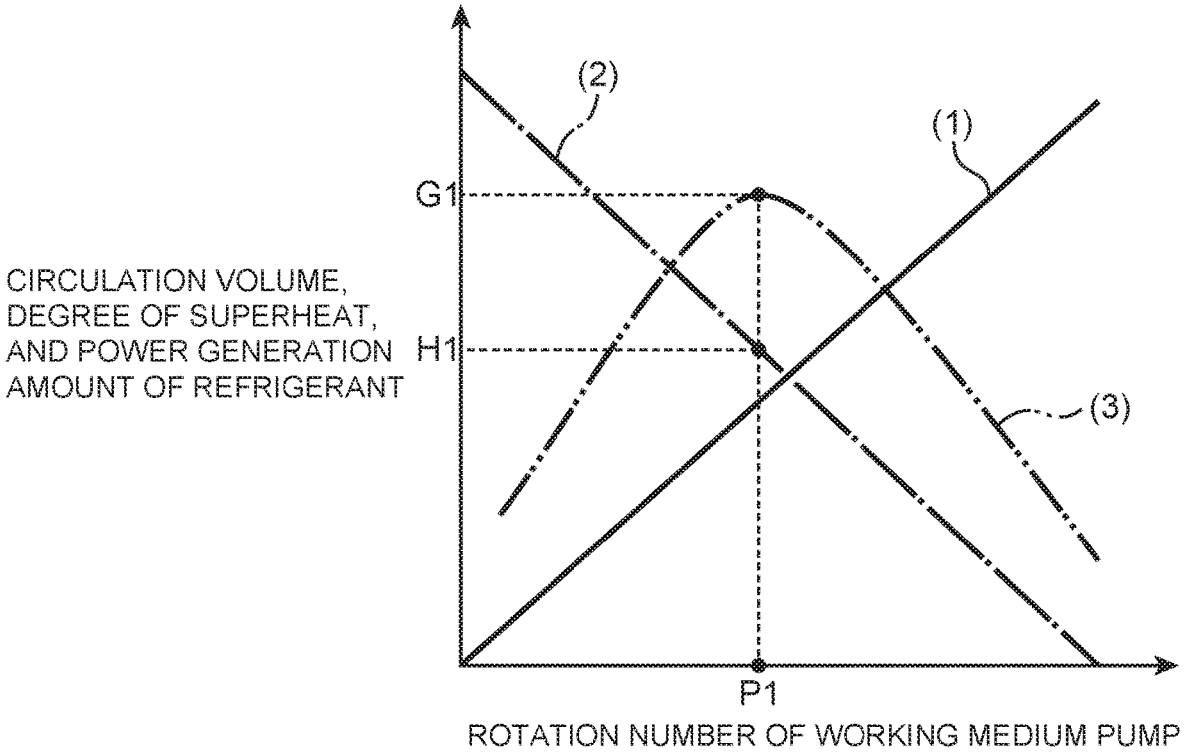
FIG. 4 is a diagram schematically showing changes in a circulation volume, a degree of superheat, and a power generation amount of a refrigerant with respect to a rotation number of a working medium pump.

FIG. 4 is a diagram schematically showing changes in the circulation volume of the refrigerant, the degree of superheat of the refrigerant, and the power generation amount (in the vertical axis) with respect to the rotation number of the working medium pump 16 (in the horizontal axis). In this figure, a solid line (1) shows the change of the circulation volume of the refrigerant with respect to the rotation number of the working medium pump 16. Moreover, a one-dot chain line (2) shows the change of the degree of superheat of the refrigerant with respect to the rotation number of the working medium pump 16. Moreover, a two-dot chain line (3) shows the change of the power generation amount with respect to the rotation number of the working medium pump 16. In addition, the lines (1) to (3) show the changes schematically to facilitate understanding, and are not intended to show strict characteristic changes.

As shown in FIG. 4, the circulation volume of the refrigerant is monotonically increased with increasing rotation number of the working medium pump 16, and on the other hand, the degree of superheat of the refrigerant is decreased with increasing rotation number of the working medium pump 16. Then, a desired power generation amount G1 is obtained by controlling the degree of superheat of the refrigerant to an optimum degree of superheat H1 (the control target value), and the rotation number of the working medium pump 16 at this time is P1 in FIG. 4. In the reference operation, in order to obtain the desired power generation amount G1, the rotation number of the working medium pump 16 is set to P1.

As described above, in the power generation method according to the present embodiment, the vapor pressure of the mixed refrigerants is same as that of the reference refrigerant. Therefore, by operating the working medium pump 16 at the pump rotation number P1 same as that in the reference operation, the degree of superheat of the mixed refrigerants can be controlled to the optimum degree of superheat H1 (the control target value), and as a result, the desired power generation amount G1 same as that in the reference operation can be obtained. Thus, even if the working medium pump 16 having the same configuration as that used in the reference operation is used as it is, it is possible to obtain the power generation amount equivalent to that in the reference operation.

It should be noted that the embodiment disclosed herein is to be considered in all the respects as illustrative and not restrictive. The scope of the present invention is indicated not by the aforementioned description but by the claims, and it is intended that all changes within the equivalent meaning and scope to the claims may be included therein.

For example, in the above embodiment, the case where the high vapor pressure refrigerant and the low vapor pressure refrigerant are the geometric isomers of the same HFO has been described, but the present invention is not limited thereto, and the both refrigerants may be a different material respectively. Moreover, the mixed refrigerants are not limited to HFO, and for example, hydrochlorofluoroolefin (HCFO) may be used.

In the above embodiment, the reference refrigerant is not limited to HFC-R245fa.

In the binary power generation device 1, a superheater which superheats the refrigerant vapor evaporated in the evaporator may be provided. And, a preheater which preheats a refrigerant liquid before flowing into the evaporator may be provided.

What is claimed is:

1. A method for generating power using a power generation device comprising a circulation pathway through which a working medium circulates, an evaporator which evaporates the working medium via heat exchange with a heat source, an expander which expands the evaporated working medium, and a power generator which generates power by a rotational driving force due to expansion of the working medium, the power generation method comprising:

a step of, during reference operation for circulating a predetermined reference refrigerant as the working medium within the circulation pathway and operating the power generation device, acquiring information of a control target value of degree of superheat of the reference refrigerant evaporated in the evaporator;

a step of filling as the working medium, in the circulation pathway, mixed refrigerants formed by mixing at least one kind of high vapor pressure refrigerant having a vapor pressure higher than that of the reference refrigerant and at least one kind of low vapor pressure refrigerant having a vapor pressure lower than that of the reference refrigerant in the ratio in which the vapor pressure thereof is equalized to that of the reference refrigerant; and a step of operating the power generation device while circulating the mixed refrigerants as the working medium within the circulation pathway and controlling degree of superheat of the mixed refrigerants evaporated in the evaporator so as to be equalized to the control target value of the degree of superheat of the reference refrigerant.

2. The power generation method according to claim 1, wherein the power generation device further comprises a working medium pump for circulating the working medium in the circulation pathway, and operation of the power generation device using the mixed refrigerants is performed at the same rotation number as that of the working medium pump during the reference operation.

3. The power generation method according to claim 1, wherein the high vapor pressure refrigerant and the low vapor pressure refrigerant are isomers to each other.

4. The power generation method according to claim 3, wherein the reference refrigerant is R245fa, the high vapor pressure refrigerant is a trans isomer of hydrofluoroolefin, and the low vapor pressure refrigerant is a cis isomer of hydrofluoroolefin having the same molecular formula as the high vapor pressure refrigerant.

5. The power generation method according to claim 4, wherein operation of the power generation device using the mixed refrigerants is performed by using the expander of positive displacement type used in the reference operation.

6. The power generation method according to claim 5, wherein the expander is a screw expander.

7. The power generation method according to claim 2, wherein the high vapor pressure refrigerant and the low vapor pressure refrigerant are isomers to each other.

* * * * *